US007722327B1

(12) United States Patent
Liang

(10) Patent No.: US 7,722,327 B1
(45) Date of Patent: May 25, 2010

(54) MULTIPLE VORTEX COOLING CIRCUIT FOR A THIN AIRFOIL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 626 days.

(21) Appl. No.: 11/732,162

(22) Filed: Apr. 3, 2007

(51) Int. Cl.
*F01D 5/18* (2006.01)

(52) U.S. Cl. ..... 416/97 R

(58) Field of Classification Search ..... 416/97 R
See application file for complete search history.

(56) References Cited

U.S. PATENT DOCUMENTS 3,542,486 A * 11/1970 Adiutori et al. ..... 416/97 R
3,934,322 A 1/1976 Hauser et al.
5,328,331 A 7/1994 Bunker et al.
5,704,763 A * 1/1998 Lee ..... 416/96 R
5,752,801 A * 5/1998 Kennedy ..... 416/97 R
6,382,907 B1 5/2002 Bregman et al.
6,481,966 B2 11/2002 Beeck et al.
6,514,042 B2 2/2003 Kvasnak et al.
6,582,584 B2 6/2003 Lee et al.
6,616,407 B2 9/2003 Barrett
6,902,372 B2 6/2005 Liang
6,955,525 B2 10/2005 Liang
6,981,846 B2 1/2006 Liang
7,011,904 B2 3/2006 Bunker
7,513,737 B2 * 4/2009 Daux et al. ..... 416/97 R
2005/0175452 A1 * 8/2005 Dube et al. ..... 416/97 R
2005/0260076 A1 * 11/2005 Daux et al. ..... 416/97 R

* cited by examiner

*Primary Examiner*—Richard Edgar
(74) *Attorney, Agent, or Firm*—John Ryznic

(57) ABSTRACT

A turbine airfoil having a thin wall construction in at least a portion of the airfoil spanwise direction, the airfoil including a leading edge cooling supply channel and a plurality of individual vortex cooling channels connected to the cooling air supply channel and extending substantially in the airfoil chordwise direction, ending at the trailing edge region and discharging the cooling air through exit holes or ducts positioned along the trailing edge region. The vortex cooling channels each include a series of metering holes leading into a vortex chamber such that the cooling air flows into the vortex chamber and around the surfaces before passing through the next metering hole and vortex chamber. The vortex cooling channels extend from the pressure side to the suction side of the airfoil walls, and are cast into the airfoil during the airfoil casting process. the hot gas side pressure distribution of the vortex cooling channels can be regulated by varying the size of the individual metering holes in the cooling circuit.

13 Claims, 3 Drawing Sheets

MULTIPLE VORTEX COOLING CIRCUIT FOR A THIN AIRFOIL

CROSS-REFERENCE TO RELATED APPLICATIONS

This application is related to co-pending U.S. patent application Ser. No. 11/642,258 filed on Dec. 20, 2006 by George Liang and entitled THIN TURBINE ROTOR BLADE WITH SINUSOIDAL FLOW COOLING CHANNELS and to co-pending U.S. patent application Ser. No. 11/642,255 filed on Dec. 20, 2006 by George Liang and entitled LARGE TAPERED ROTOR BLADE WITH NEAR WALL COOLING.

BACKGROUND OF THE INVENTION

1. Field of the Invention

The present invention relates generally to fluid reaction surfaces, and more specifically to thin walled turbine airfoils with cooling circuits.

2. Description of the Related Art Including Information Disclosed Under 37 CFR 1.97 and 1.98

In a gas turbine engine such as an industrial gas turbine engine, a turbine section includes a plurality of rotor blades that react with the hot gas flow passing through the turbine to produce mechanical work by rotating the rotor shaft. In an industrial gas turbine, four stages of rotor blades and stator vanes are used to extract the energy from the flow. As the inlet temperature to the turbine increases, the size of the fourth stage rotor blade also increases because the flow into the fourth stage has higher energy than previous lower temperature engines. These fourth stage rotor blades can be over 30 inches from platform to blade tip, and also have very large taper and twist in order to react with the flow.

With the higher gas flow temperature exposed to the fourth stage blade, internal air cooling is required in order to increase the life of the rotor blade. However, prior art methods of casting turbine blades having internal cooling circuits are not practical with these larger blades. Radial holes cannot be drilled into the blade because of the large amount of twist from the root to the tip. A straight hole cannot be placed within the blade. These large twist blades have large cross sectional areas in the lower span but have thin cross sectional areas in the upper span. Thus, the rotor blade in the upper span is very thin and thus not acceptable to casting processes of the prior art. Also, ceramic cores used for investment casting of these blades cannot be used in these long and highly twisted blades because the ceramic core would also have a long length with high twist. This produces a very brittle core which would un-twist when hanging within the mold used to cast the blade with the internal cooling passages. Core ties would break and result in improper positioning of the core within the mold. Defective blades would be cast that would also increase the overall cost of manufacturing the usable rotor blades. Therefore, there is a need in the art for producing a long rotor blade with thin airfoil walls with a cooling circuit to provide cooling for the blade.

It is an object of the present invention to provide a thin walled turbine airfoil with an internal cooling air circuit to provide cooling for the airfoil.

BRIEF SUMMARY OF THE INVENTION

A turbine airfoil with a thin wall cross sectional area, the airfoil having a cooling air supply channel positioned along the leading edge of the airfoil, and a plurality of chordwise extending cooling channels extending from the leading edge to the trailing edge, where each channel includes a plurality of vortex chambers connected in series by inlet metering holes.

Cooling air from the leading edge supply channel flows through a metering hole and into a first vortex chamber, then through a second metering hole and into a second vortex chamber, and continues in this process until exiting through a trailing edge exit hole. The vortex chambers are circular in shape and include trip strips or a roughened surface on the inner surfaces to promote heat transfer to the cooling air flow.

DETAILED DESCRIPTION OF THE INVENTION

Figure 1:
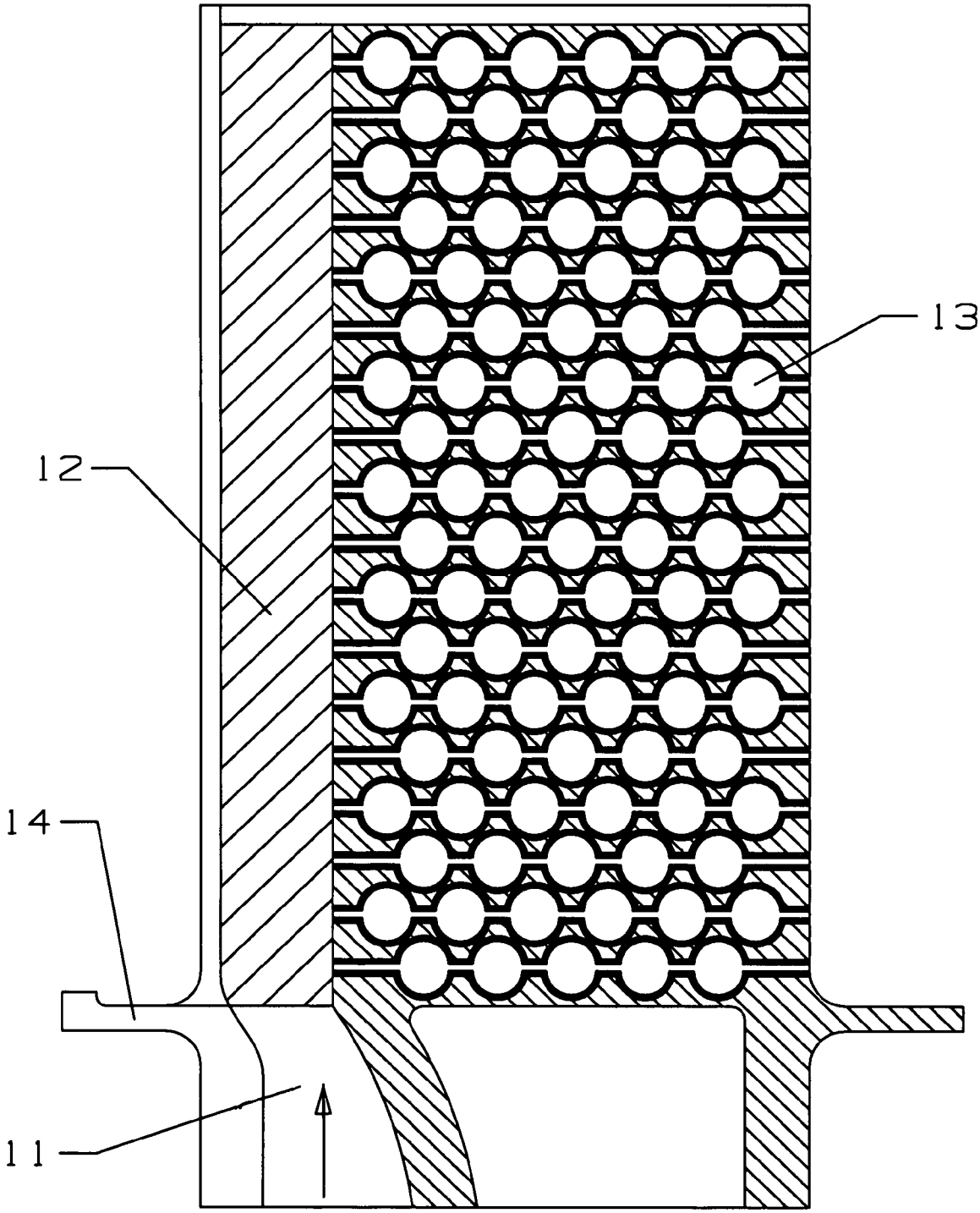
FIG. 1 shows a cross section side view of a turbine blade of the present invention.

The present invention is a turbine airfoil having thin wall cross section with an internal cooling air circuit to provide cooling for the airfoil. The airfoil can be a stator vane or a rotor blade. In the preferred embodiment, the airfoil is a rotor blade used in the fourth or last stage of a turbine in an industrial gas turbine engine. The fourth stage rotor blade includes an upper span portion with thin airfoil walls. However, the airfoil can include the cooling circuit of the present invention extending from the platform 14 to the blade tip as shown in FIG. 1. The blade includes a leading edge cooling supply channel 12 supplied with cooling air from the root channel 11. A showerhead arrangement of leading edge film cooling holes can be used (not shown in FIG. 1) connected to the leading edge cooling supply channel 12 to provide film cooling. Connected to the leading edge cooling supply channel 12 are a plurality of multiple vortex channels 13 extending along the chordwise length of the blade and ending at the trailing edge along exit holes. Adjacent multiple vortex channels 13 are offset (180 degrees out of phase) as shown in FIGS. 1 and 2 in order to maximize the space these channels occupy.

Figure 2:
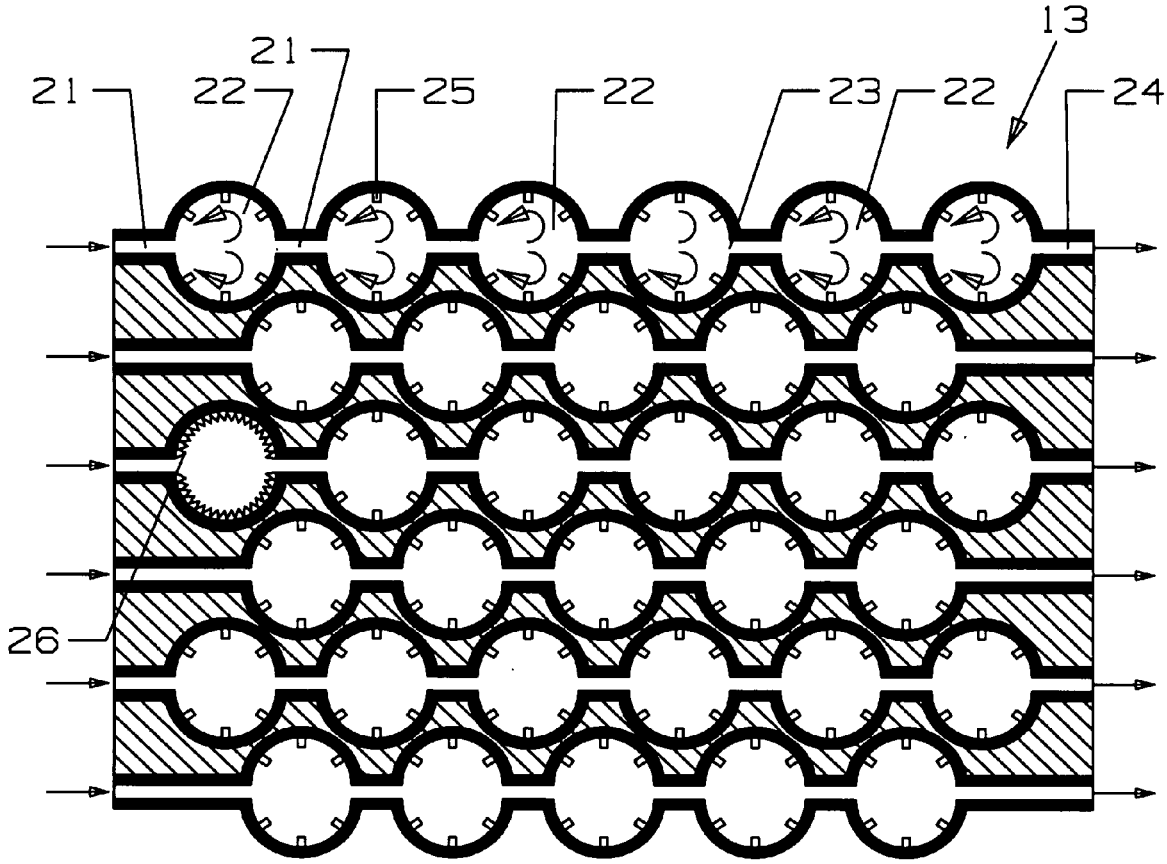
FIG. 2 shows a detailed view of the vortex chambers used in the cooling circuit of the present invention.

A more detailed view of the multiple vortex channels 13 is shown in FIG. 2 in which the vortex channel 13 includes an inlet metering hole 21 connected to the supply channel 12, a first vortex chamber 22 immediately downstream from the inlet metering hole 21, a second vortex chamber connected to the first vortex chamber through a metering hole, and additional vortex chambers connected in series through metering holes connecting adjacent vortex chambers. The last vortex chamber 22 is connected to an exit hole 24 that discharges the cooling air out through the trailing edge region of the blade. The exit holes 24 can be holes opening onto the trailing edge of the airfoil, or they can be slots opening onto the pressure side wall of the trailing edge region, or any other prior art trailing edge region discharging and cooling holes.

Each vortex chambers 22 has a circular cross sectional shape as shown in the figures, and is offset from the vortex chamber above or below in order to maximize the space for the cooling circuit by compacting as many of the vortex chambers into the space provided along the airfoil. The vortex chambers 22 can be any shape that will provide for a vortex flow within the chamber for the cooling air. Each vortex chamber 22 also includes trip strips 25 or a roughened surface 26 to promote the heat transfer from the metal to the cooling air flow. The space between the vortex channels 13 is solid material of the airfoil.

Figure 3:
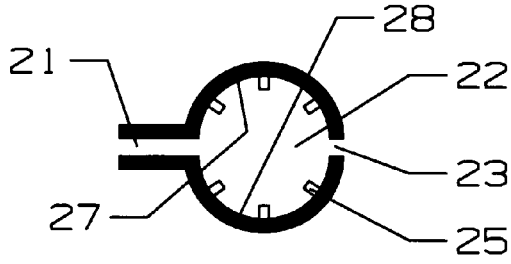
FIG. 3 shows a detailed view of one of the vortex chambers from FIG. 2.

FIG. 3 shows a detailed view of one of the vortex chambers 22 used in the present invention. The inlet metering hole 21 delivers cooling air into the vortex chamber 22 which is formed by an upper wall 27 and a lower wall 28. Trip strips 25 extend along the inner surface of the vortex chamber 22 to promote heat transfer to the cooling air flow. A cooling air exit hole 23 allows for the cooling air to flow out form the vortex chamber and into the next metering hole and vortex chamber within the channel 13. As the cooling air flows through the inlet metering hole 21 and into the vortex chamber 22, the cooling air will flow in the direction of the two arrows shown in FIG. 2. The trip strips 25 will force the cooling air to flow against the inner surface of the chamber 22 repeatedly. Then, the cooling air will flow toward the exit hole 23 and into the next chamber to repeat this process again.

Figure 4:
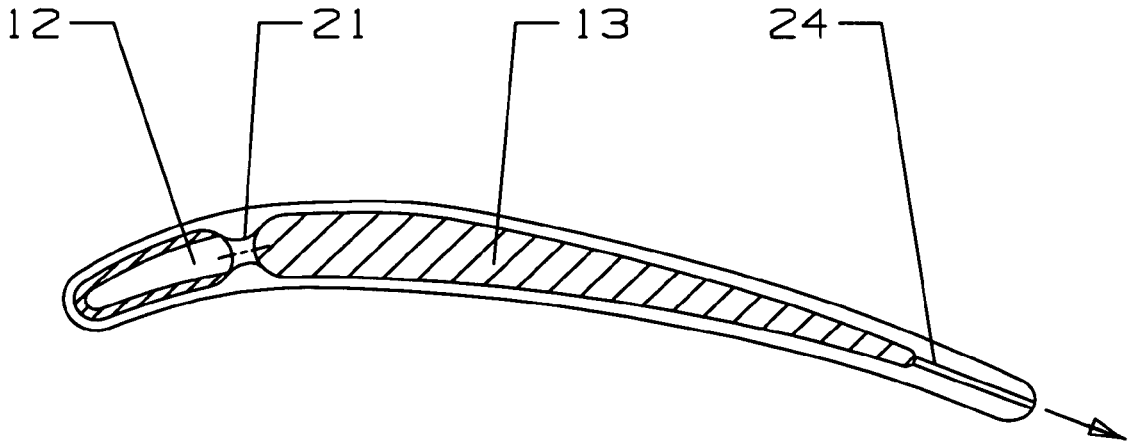
FIG. 4 shows a cross section top view of one of the cooling passages from FIG. 1.

The upper walls 27 and the lower walls 28 and the metering holes 21 extend from the pressure side wall to the suction side wall of the airfoil (as seen in FIG. 4) and form the holes and chambers of the vortex cooling channel 13. These 21 holes and chambers 22 are cast into the airfoil during the casting process. Ceramic core ties are used to form the channels 13 within the airfoil.

FIG. 4 shows a top view of one of the vortex channels 13 from the FIG. 1 airfoil. The leading edge supply channel 12 is shown in the leading edge region of the blade. The first metering hole 21 connects the supply channel 12 to the vortex channel 13 that extends along the airfoil chordwise direction. The exit hole 24 connects the vortex channel 13 to the trailing edge of the blade to discharge the cooling air from the channel 13.

The multiple vortex chambers can be designed based on airfoil hot gas side pressure distribution in both chordwise and spanwise directions. This is done by varying the metering holes at the inlet of each individual channel 13 as well as varying the metering flow orifice within each vortex channel. Also, each individual vortex chamber can be designed based on the airfoil local external heat load to achieve a desired local metal temperature level. This is achieved by varying the tangential velocity and pressure level within the vortex chamber with different pressure ratio across the cooling metering flow orifice. Trip strips in the vortex flow direction or two dimensional bumps built into the inner walls of the vortex chambers will further enhance the internal heat transfer performance.

In operation, the cooling air flow initiated from the airfoil leading edge radial cooling flow channel is bled off through a row of metering holes for the proper distribution of cooling air into each individual vortex flow channel. The cooling flow can be distributed based on the airfoil spanwise metal temperature requirement. The inter-linked vortex chambers provide a long flow path for the coolant parallel to the chordwise direction of the gas path pressure and temperature profile. The cooling flow can be distributed based on the airfoil chordwise metal temperature requirement by varying the inter-linked metering orifice. The vortex chambers create a high overall coolant velocity and high heat transfer while the long flow path yields high overall cooling effectiveness. The injection process for the cooling air repeats throughout the entire inter-linked vortex chambers and then discharges the coolant from the airfoil trailing edge through multiple cooling holes or slots.

I claim:

1. A turbine airfoil for use in a gas turbine engine, the airfoil comprising:

a leading edge cooling air supply channel connected to a source of cooling air to supply cooling air to the airfoil;

a plurality of vortex cooling channels each extending substantially along a chordwise direction of the airfoil, the vortex cooling channels each including a series of vortex chambers connected by a series of metering holes to channel cooling air forming separate vortex cooling channels;

an inlet metering hole to connect the cooling air supply channel to the vortex cooling channel; and, an exit hole to discharge cooling air from the vortex cooling channel to the trailing edge region of the airfoil.

2. The turbine airfoil of claim 1, and further comprising:

the plurality of vortex cooling channels each extends from a pressure side wall to a suction side wall of the airfoil.

3. The turbine airfoil of claim 2, and further comprising:

the metering holes extend from a pressure side wall to a suction side wall of the airfoil.

4. The turbine airfoil of claim 1, and further comprising:

the vortex chambers are elliptical in cross sectional shape.

5. The turbine airfoil of claim 1, and further comprising:

the vortex chambers include trip strips to promote the transfer of heat to the cooling air passing through.

6. The turbine airfoil of claim 1, and further comprising:

adjacent ones of the vortex cooling channels being shifted such that close packing of the vortex cooling channels in the blade spanwise direction can be formed.

7. A turbine airfoil for use in a gas turbine engine, the airfoil comprising:

a leading edge cooling air supply channel connected to a source of cooling air to supply cooling air to the airfoil;

a vortex cooling channel extending substantially along a chordwise direction of the airfoil, the vortex cooling channel including a series of vortex chambers connected by metering hole to channel cooling air;

an inlet metering hole to connect the cooling air supply channel to the vortex cooling channel;

an exit hole to discharge cooling air from the vortex cooling channel to the trailing edge region of the airfoil;

a second vortex cooling channel is located adjacent to the first vortex cooling channel, the second vortex cooling channel extending substantially along a chordwise direction of the airfoil, the vortex cooling channel including a series of vortex chambers connected by metering hole to channel cooling air;

an inlet metering hole to connect the cooling air supply channel to the second vortex cooling channel;

an exit hole to discharge cooling air from the second vortex cooling channel to the trailing edge region of the airfoil; and, the second vortex cooling channel is shifted 180 degrees out of phase from the first vortex cooling channel.

8. The turbine airfoil of claim 7, and further comprising:

a plurality of vortex cooling channels with adjacent channels shifted 180 degrees extends along the airfoil in the thin walled portions.

9. The turbine airfoil of claim 8, and further comprising:

the metering holes on at least some of the vortex chambers are sized to regulate an amount of cooling for the hot gas side of the airfoil in both the chordwise and spanwise direction of the airfoil.

10. The turbine airfoil of claim 8, and further comprising:

the vortex cooling channels and the metering holes are cast into the airfoil.

11. The turbine airfoil of claim 8, and further comprising:

the plurality of vortex cooling channels is fluidly separated from each other between the cooling air supply channel and the outlet of the exit cooling holes.

12. The turbine airfoil of claim 7, and further comprising:

a space formed between adjacent vortex cooling channels is solid.

13. The turbine airfoil of claim 7, and further comprising:

the two vortex cooling channels are fluidly separated from each other between the cooling air supply channel and the outlet of the exit cooling holes.

* * * * *